US008197642B2

(12) United States Patent
Aizawa

(10) Patent No.: US 8,197,642 B2
(45) Date of Patent: Jun. 12, 2012

(54) INORGANIC BOARD AND METHOD FOR MANUFACTURING THE SAME

(75) Inventor: Hideo Aizawa, Nagoya (JP)

(73) Assignee: Nichiha Corporation, Nagoya-Shi (JP)

( * ) Notice: Subject to any disclaimer, the term of this patent is extended or adjusted under 35 U.S.C. 154(b) by 865 days.

(21) Appl. No.: 11/878,794

(22) Filed: Jul. 26, 2007

(65) Prior Publication Data

US 2009/0025897 A1 Jan. 29, 2009

(51) Int. Cl.
*D21H 17/68* (2006.01)
*D21H 27/18* (2006.01)

(52) U.S. Cl. ..... 162/225; 162/181.6

(58) Field of Classification Search ..... 162/181.6, 162/225; 106/698, 707–709, 713, 714
See application file for complete search history.

(56) References Cited

U.S. PATENT DOCUMENTS

| | | | | | |
|---|---|---|---|---|---|
| 2,446,990 | A | * | 4/1949 | Schuetz | 188/366 |
| 3,501,324 | A | * | 3/1970 | Kubo | 106/796 |
| 4,131,638 | A | | 12/1978 | Whitaker et al. | |
| 4,132,555 | A | * | 1/1979 | Barrable | 106/795 |
| 4,162,924 | A | | 7/1979 | Kubo et al. | |
| 4,680,059 | A | | 7/1987 | Cook et al. | |
| 4,689,084 | A | | 8/1987 | Ambroise et al. | |
| 4,840,672 | A | * | 6/1989 | Baes | 106/716 |
| 5,330,573 | A | | 7/1994 | Nakano et al. | |
| 5,372,678 | A | * | 12/1994 | Sagstetter et al. | 162/225 |
| 5,383,967 | A | | 1/1995 | Chase | |
| 5,385,764 | A | * | 1/1995 | Andersen et al. | 428/34.4 |
| 5,709,743 | A | | 1/1998 | Leture et al. | |
| 6,139,620 | A | | 10/2000 | Suzuki et al. | |
| 6,676,744 | B2 | * | 1/2004 | Merkley et al. | 106/674 |
| 2002/0139082 | A1 | * | 10/2002 | DeFord et al. | 52/783.1 |
| 2005/0072966 | A1 | * | 4/2005 | Bergh et al. | 256/19 |
| 2005/0208285 | A1 | * | 9/2005 | Lyons et al. | 428/292.1 |

FOREIGN PATENT DOCUMENTS

| | | |
|---|---|---|
| JP | 8-32603 B2 | 3/1996 |
| JP | 3374515 B2 | 11/2002 |

OTHER PUBLICATIONS

Rydholm, S., Pulping Processes, John Wiley & Sons, 1965, pp. 51-52.*

* cited by examiner

*Primary Examiner* — Matthew Daniels
*Assistant Examiner* — Dennis Cordray
(74) *Attorney, Agent, or Firm* — Birch, Stewart, Kolasch & Birch, LLP

(57) ABSTRACT

An object of the present invention is to provide an inorganic board lighter in weight and excellent in strength and rigidity, and a method of producing the inorganic board. An inorganic board described in claim 1 for accomplishing the object comprises a hydraulic inorganic material, an inorganic lightweight material, a woody reinforcing material and a calcium silicate hydrate, wherein a ratio of the calcium silicate hydrate to the hydraulic inorganic material is 3-54 parts by mass: 100 parts by mass. Thus, by making an inorganic board, made of a hydraulic inorganic material, an inorganic lightweight material and a woody reinforcing material as main components, further contain a calcium silicate hydrate, an inorganic board which is lightweight and excellent in strength and rigidity can be obtained.

4 Claims, No Drawings

INORGANIC BOARD AND METHOD FOR MANUFACTURING THE SAME

FIELD OF THE INVENTION

The present invention relates to an inorganic board containing a hydraulic inorganic material, an inorganic lightweight material and a woody reinforcing material as main components and further calcium silicate hydrate.

BACKGROUND TECHNOLOGY

There has been an inorganic board containing a hydraulic inorganic material such as a cement, and a woody reinforcing material such as a pulp as main components. This inorganic board has a high specific gravity and a good freezing thawing resistance. However, in the case of adding plenty of pulp thereto in order to increase a bending strength, incombustibility is lowered and freezing thawing resistance is deteriorated. Also as an inorganic board with high specific gravity is hard, which causes constructability (such as easiness in putting in a nail) to become worse. In view of this, a variety of lightweight materials have tried to be added thereto. For example, JP Patent 3374515 discloses a cement molding material containing a vermiculite and JP kokoku (examined patent application publication) 08-32603 discloses an addition of a fly ash and/or a spherical calcium silicate.

BRIEF SUMMARY OF THE INVENTION

An object of the present invention is to provide an inorganic board lighter in weight and excellent in strength and rigidity, and a method for producing the inorganic board.

An inorganic board described in embodiment 1 for accomplishing the object comprises a hydraulic inorganic material, an inorganic lightweight material, a woody reinforcing material and a calcium silicate hydrate, wherein a ratio of the calcium silicate hydrate to the hydraulic inorganic material is 3-54 parts by mass: 100 parts by mass.

An inorganic board described in embodiment 2 is an inorganic board of embodiment 1 wherein the calcium silicate hydrate is a xonotlite.

An inorganic board described in embodiment 3 is an inorganic board of embodiment 1 wherein the hydraulic inorganic material is a cement and/or a slag, the inorganic lightweight material is a perlite, and the woody reinforcing material is a woody pulp.

A method for producing an inorganic board described in embodiment 4 comprises steps of: preparing a raw material slurry by mixing 55.6-86.0 parts by mass of hydraulic inorganic material, 2.45-7.5 parts by mass of inorganic lightweight material, 5-15 parts by mass of woody reinforcing material, and 3-30 parts by mass of calcium silicate hydrate; forming a mat by processing the raw material slurry using a sheetmaking process; and press-molding the mat.

A method for producing an inorganic board described in embodiment 5 is a method of embodiment 4 wherein the hydraulic inorganic material is a cement and/or a slag, the inorganic lightweight material is a perlite, the woody reinforcing material is a woody pulp, and the calcium silicate hydrate is a xonotlite.

The present invention can provide an inorganic board which is lightweight and excellent in strength and rigidity, and a method for producing the inorganic board.

DETAILED DESCRIPTION OF THE INVENTION

Preferred embodiments of the present invention will be explained below. An inorganic board of the present invention contains a hydraulic inorganic material, an inorganic lightweight material and a woody reinforcing material as main components and further contains calcium silicate hydrate.

As to a hydraulic inorganic material, although a cement, a slag and a gypsum are available, it is preferable to use at least either a cement or a slag.

As to an inorganic lightweight material, although a perlite, a fly-ash balloon and a Shirasu balloon are available, it is preferable to use a perlite.

As to a woody reinforcing material, although a woody pulp, a wood fiber, a bundle of woody fibers, a waste paper and a microfibril cellulose are available, it is preferable to use a woody pulp processed by DDR (double disk refiner) having a diameter of 5-25 μm and a length of 1.5-3.0 mm.

A calcium silicate hydrate, as mentioned above, means a hydrate produced through silicic acid-calcium reaction between a siliceous raw material and a calcareous raw material in the slurry thereof under high temperature and high pressure condition, wherein the siliceous raw material means a material mainly consisting of $SiO_2$ such as silica sand, silica powder, diatomaceous earth, silica fume, feldspar, clay mineral or fly-ash; and the calcareous raw material means a material mainly consisting of CaO such as quick lime or slaked lime. When a slurry made of the siliceous raw material and the calcareous raw material dispersed into water is heated with agitation under pressure, a calcium silicate hydrate such as a tobermorite and/or xonotlite can be formed through silicic acid-calcium reaction in the slurry. It is preferable to use xonotlite ($6CaO.6SiO_2.H_2O$) has a higher fire resistance than that of tobermorite ($5CaO.6SiO_2.5H_2O$) due to the structure thereof. In order to produce xonotlite as a preferable calcium silicate hydrate, it is preferable that the molar ratio of $SiO_2$ contained in the siliceous raw material to CaO contained in the calcareous raw material is prepared to be between 7 to 3 and 3 to 7, i.e., $SiO_2$: CaO=7:3-3:7, a solid content of the slurry is normally prepared to be about 5-40% by mass, and the reaction is prepared to be carried out in the autoclave with agitation for 1-12 hours under a pressure of 1.0-2.2 Mpa and a temperature of 170-220° C. If a slag containing silica component is added after this reaction, a calcium ion eluted from the calcareous raw material in the xonotlite slurry reacts with the silica component to contribute to the strength improvement. Also, calcium silicate hydrate produced in advance or micronized calcium silicate made by pulverizing a calcium silicate plate can be used.

In addition, as a waterproof agent, a wax, a silicon oil, an acrylic emulsion or a succinic acid can be added. By adding a waterproof agent, water absorption can be kept very low. The amount of the waterproof agent to be added is preferably 10% by mass or less based on the amount of solid content. When needed, the following can be added, i.e., an aggregate such as a mica or a vermiculite, an inorganic fiber reinforcing material such as a rock wool or glass fiber, and an organic fiber reinforcing material such as polypropylene fiber or vinylon fiber.

A method for producing the inorganic board of the present invention will be described below. First, a hydraulic inorganic material, an inorganic lightweight material, a woody reinforcing material, and calcium silicate hydrate are mixed with water to form a raw material slurry, and then subjected to a wet sheetmaking process such as a Hatschek process or flow-on process. Slurry concentration is preferably 1-20% by mass. In the case of using a flow-on process, a raw material slurry is cast onto an endless felt to make a sheet by dehydration, then the sheet is taken up on a making roll and after the thickness reaches a predetermined value, the sheet is cut out to form a mat-by-sheetmaking. The mat-by-sheetmaking is press-molded under a pressure of 1-7 MPa, then cured at a temperature of 50-90° C. for 12-72 hours to form the inorganic board.

Blend ratio of the raw materials is preferably 55.6-86.0 parts by mass of hydraulic inorganic material, 2.45-7.5 parts by mass of inorganic lightweight material, 5-15 parts by mass of woody reinforcing material, and 3-30 parts by mass of calcium silicate hydrate. If the mass of hydraulic inorganic material is less than 55.6 parts by mass, a desirable value of strength cannot be obtained, and if more than 86.0 parts, the specific gravity increases, which may cause some problems in constructability. If the mass of inorganic lightweight material is less than 2.45 parts by mass, there is little contribution to becoming lightweight, and if more than 7.5 parts, the raw material becomes bulky, which deteriorates the state of the raw material slurry to keep the specific gravity of the inorganic board low and leads to a lowering of various properties. If the mass of woody reinforcing material is less than 5 parts by mass, it cannot contribute to a strength and/or a shape retainability, and if more than 15 parts, it may deteriorate the fire resistance/fire-retardant property thereof. If the mass of calcium silicate hydrate is less than 3 parts by mass, the specific gravity cannot be lowered, i.e., weight of the board cannot be lowered, and if more than 30 parts, the specific gravity becomes too low, which makes it difficult to retain shape without increasing the pressure of press-molding.

Thus, by making an inorganic board, made of a hydraulic inorganic material, an inorganic lightweight material and a woody reinforcing material as main components, and further containing calcium silicate hydrate, an inorganic board which is lightweight and excellent in strength and rigidity can be obtained.

EXAMPLES

Examples of the present invention are described below. Examples 1-3 and Comparison Examples 1-2 were carried out under the condition of blend ratio of raw materials and manufacturing shown in Table 1.

TABLE 1

| | | Example 1 | Example 2 | Example 3 | Comparison Example 1 | Comparison Example 2 |
|---|---|---|---|---|---|---|
| Blend (parts by mass) | xonotlite | 10 | 20 | 29 | 0 | 40 |
| | cement/slag *1 | 75 | 65 | 56 | 85 | 45 |
| | woody pulp *2 | 10 | 10 | 10 | 10 | 10 |
| | perlite | 5 | 5 | 5 | 5 | 5 |
| Manufacturing condition | pressure for press-molding (MPa) | 2 | 3.5 | 5 | 0.2 | 3.5 |
| Physical property | Bending strength ($N/mm^2$) *3 | 13.3 | 15.2 | 16.4 | 8.8 | 15.4 |
| | Young's modulus ($kN/mm^2$) *3 | 4.4 | 4.6 | 5.5 | 2.8 | 5.1 |
| | Specific gravity | 1.00 | 1.00 | 1.00 | 1.00 | 0.81 |

*1 Ratio of cement to slag is 4:6

*2 Woody pulp processed by DDR (double disk refiner) having a diameter of 5-25 μm and a length of 1.5-3.0 mm.

*3 Pursuant to JIS A 1408

Table 1 shows the following: The inorganic board of Example 1 includes 10 parts of xonotlite and 75 parts of cement/slag, possesses a 1.00 specific gravity and is excellent in bending strength. The inorganic board of Example 2 includes 20 parts of xonotlite and 65 parts of cement/slag, possesses a 1.00 specific gravity and is excellent in bending strength. The inorganic board of Example 3 includes 29 parts of xonotlite and 56 parts of cement/slag, possesses a 1.00 specific gravity and is excellent in bending strength. In the inorganic board of Comparison Example 1 without a xonotlite, the pressure of press-molding does not increase, which leads to poor bending strength. In the inorganic board of Comparison Example 2 with 40 parts of xonotlite, the bending strength is high enough but the specific gravity becomes too low.

What is claimed is:

1. An inorganic board comprising:

a cement;

a slag containing a silica component;

an inorganic lightweight material;

a woody reinforcing material; and a xonotlite, wherein total amount of the cement and the slag is 56 to 75 parts by mass and mass ratio of the cement: the slag is approximately 4:6, amount of the xonotlite is 10-29 parts by mass, the amount of woody reinforcing material is 5-15 parts by mass, and the amount of inorganic lightweight material is 2.45-7.5 parts by mass, each amount per 100 parts by mass of the cement, the slag, the inorganic lightweight material, the woody reinforcing material and the xonotlite, and the woody reinforcing material has a diameter of 5-25 μm and a length of 1.5-3.0 mm.

2. The inorganic board according to claim 1, wherein the inorganic lightweight material is a perlite, and the woody reinforcing material is a woody pulp.

3. A method for producing an inorganic board, comprising steps of:

preparing a raw material slurry by mixing 55.6-86.0 parts by mass of a hydraulic inorganic material, 2.45-7.5 parts by mass of an inorganic lightweight material, 5-15 parts by mass of a woody reinforcing material, and 3-30 parts by mass of calcium silicate hydrate slurry;

forming a mat by processing the raw material slurry using a sheetmaking process; and press-molding the mat, wherein the hydraulic inorganic material comprises a cement and a slag containing a silica component, the woody reinforcing material has a diameter of 5-25 μm and a length of 1.5-3.0 mm, and the calcium silicate hydrate slurry comprises a xonotlite obtained by dispersing a siliceous raw material and a calcareous raw material into water to form a slurry, heating the slurry with agitation under pressure to form the xonotlite in the slurry, and the slag is added to the calcium silicate hydrate slurry so that a calcium ion eluted from the calcareous raw material in the calcium silicate hydrate slurry reacts with the silica component of the slag, thereby obtaining the raw material slurry, and total amount of the cement and the slag is 56 to 75 parts by mass and mass ratio of the cement: the slag is approximately 4:6 and amount of the xonotlite is 10-29 parts by mass, each amount per 100parts by mass of the cement, the slag, the inorganic lightweight material, the woody reinforcing material and the xonotlite.

4. The method according to claim 3, wherein the inorganic lightweight material is a perlite, and the woody reinforcing material is a woody pulp.

* * * * *